US006194329B1

(12) United States Patent
Nelson et al.

(10) Patent No.: US 6,194,329 B1
(45) Date of Patent: Feb. 27, 2001

(54) REVERSIBLE FABRIC FOR USE IN MILITARY ENVIRONMENTS AND METHOD OF MAKING SAME

(75) Inventors: Steve Nelson, Greenwich; Benito Boiardi, Warwick, both of RI (US)

(73) Assignee: Brookwood Companies, Incorporated, New York, NY (US)

( * ) Notice: Subject to any disclaimer, the term of this patent is extended or adjusted under 35 U.S.C. 154(b) by 0 days.

(21) Appl. No.: 09/234,386

(22) Filed: Jan. 20, 1999

Related U.S. Application Data

(60) Provisional application No. 60/072,055, filed on Jan. 21, 1998.

(51) Int. Cl.[7] ..... B32B 27/04

(52) U.S. Cl. ..... 442/71; 442/66; 442/69; 442/74; 442/75; 442/79; 442/85; 442/86; 442/89; 442/131; 442/170; 442/171; 442/293; 428/919

(58) Field of Search ..... 442/86, 89, 293, 442/79, 85, 71, 74, 75, 131, 66, 69, 170, 171; 428/919

(56) References Cited

U.S. PATENT DOCUMENTS

| | | | | |
|---|---|---|---|---|
| 3,349,396 | | 10/1967 | Reed . | |
| 3,349,397 | | 10/1967 | Rosenthal . | |
| 4,001,827 | | 1/1977 | Wallin et al. . | |
| 4,064,305 | | 12/1977 | Wallin . | |
| 4,142,015 | | 2/1979 | Bienz . | |
| 4,243,709 | | 1/1981 | Morton . | |
| 4,308,882 | | 1/1982 | Pusch et al. . | |
| 4,442,162 | | 4/1984 | Kuester . | |
| 4,560,608 | | 12/1985 | Pusch et al. . | |
| 4,565,729 | * | 1/1986 | Liggett et al. | 428/201 |
| 4,594,286 | | 6/1986 | McKinney et al. . | |
| 4,869,952 | * | 9/1989 | Levy | 428/252 |
| 4,892,906 | | 1/1990 | Pham et al. . | |
| 4,953,922 | | 9/1990 | Granqvist . | |
| 5,986,773 | * | 11/1999 | Lee | 442/89 |

* cited by examiner

*Primary Examiner*—Terrel Morris
*Assistant Examiner*—Norca L. Torres-Velázquez
(74) *Attorney, Agent, or Firm*—Alston & Bird LLP

(57) ABSTRACT

A reversible fabric particularly for use in the production of military rainflies is described. The fabric has first and second faces, each of which has a visually distinct color in order that rainflies and other articles made from the fabric can be used to provide inconspicuous shelter in two visually distinct environments. Each of the sides of the fabric provides requisite degrees of visual opacity and infrared reflectance, as well as other functional properties—such as water-resistance, etc. The fabric includes a dyed textile substrate and three coats of pigmented polyurethane having varying compositions; the composite fabric can be produced by a coating and/or laminating process.

1 Claim, 1 Drawing Sheet

REVERSIBLE FABRIC FOR USE IN MILITARY ENVIRONMENTS AND METHOD OF MAKING SAME

CROSS-REFERENCE TO RELATED APPLICATIONS

Figure 1:
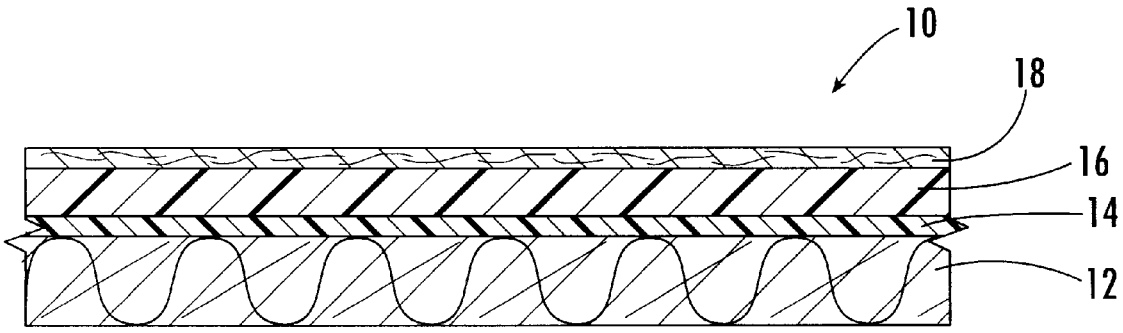

This application claims the benefit of Provisional Application No. 60/072,055, filed Jan. 21, 1998, the disclosure of which is incorporated herein by reference.

BACKGROUND OF THE INVENTION

1. Field of the Invention

The invention is directed to a flexible urethane coated and/or laminated textile material for use particularly in the manufacture of rainflies for military tents, and for rainflies made from such material. More specifically, the invention relates to reversible lightweight urethane coated and/or laminated fabrics which meet predetermined levels of opacity, ultra-violet protection, flame retardancy, cold weather crack resistance, mildew resistance, abrasion resistance, and infra-red reflectance within specified wavelengths when either fabric side is facing outwardly, and for methods of making the fabric.

2. Description of the Prior Art

Rainflies are often used over the top of conventional-type tents to form what are commonly known as double-walled systems. Such flies are adapted to add protection from driving wind and/or rain for all the openings of the tent, in addition to providing supplemental shelter or storage space. Currently, members of the military are required to have several differently colored rainflies in order to provide inconspicuous shelter in different environments. (For purposes of this application, the term "color" is meant to encompass black and white as well as other traditional colors.) For example, military rainflies are generally available in camouflage, white for arctic conditions, green for tropical conditions, and tan for desert regions. In addition to providing protection from wind, such rainflies must be waterproof, flame-retardant, cold weather crack resistant, mildew resistant, abrasion resistant, meet a predetermined visual shade requirement, provide a high degree of visual opacity (i.e. ability to "black out" light from the interior of the tent) and provide a degree of infrared reflectance within specified wavelengths. Furthermore, because military personnel are often forced to transport their equipment, it is necessary that the weight of such rainflies be minimized. Several rain fly and tent fabrics are described in U.S. Pat. No. 4,594,286 to McKinney et al., U.S. Pat. No. 4833,006 to McKinney et al., and U.S. Pat. No. 4,308,882 to Pusch et al., the disclosures of which are incorporated herein by reference.

Prior art rainflies generally include a polyurethane coating which is either clear or colored to match the ground fabric. Other rainflies for use in arctic environments have been made using a black ground fabric in combination with a white coating, with the black ground fabric being designed to help provide the requisite opacity to the white structure. However, heretofore rainflies have only been designed to provide the requisite opacity, visual color and IR characteristics on a single side. As a result, military personnel are often required to be equipped with two or more such rainflies, when they are expected to encounter more than one environmental condition (e.g. where they are to be dispatched to a region having both snowy areas and woodsy areas.) Because it is generally desirable to minimize a soldier's load to the extent possible, having to carry more than one rainfly to anticipate and be able to respond to varying climactic conditions can add undesirably to the bulk and weight of a soldier's load.

Conventional one-sided fabrics generally utilize a ground fabric having a coated weight varying from about 2.5 to 4.5 oz per square yard. In such products, it is generally the coated side of the fabric which provides the requisite physical characteristics.

SUMMARY OF THE INVENTION

With the foregoing in mind, it is therefore an object of the present invention to provide a fabric which provides specific physical properties such as opacity and infrared (IR) characteristics on each of its two sides, to render it useful in military rainflies, and which has a different visual color on each of its two sides, so that it can provide inconspicuous shelter in two distinct environments.

It is also an object of the instant invention to provide methods for making such fabrics in an efficient and cost effective manner.

The process for producing fabric according to the instant invention involves the sequential application of several coating layers to a substrate. Although the substrate would generally be woven, it is contemplated that it could also be another type of textile substrate such as a knitted or non-woven material. The substrate is dyed to a first visual shade match using dyes specifically selected to provide a predetermined level of infrared reflectance within specified wave lengths. The substrate is desirably relatively lightweight (e.g., about 1.6–1.9 ounces) in order that the overall weight of the fabric is relatively low. A base coat compound is desirably applied to the substrate at a thickness of about 0.25 to about 0.5 mils. The base coat preferably consists essentially of a fire-retardant pigmented polyester polyurethane. This base coat is desirably applied from a solvent solution with a sufficiently high viscosity to prevent penetration to the opposite side of the fabric. The coating also desirably contains a pigment closely matching the ground shade of the substrate. The pigment volume concentration should be sufficiently high to prevent the ground shade from changing when applying the "opacifying" coat.

A mid-coat is then applied, preferably at a thickness on the order of about 0.5 to about 1.0 mils. The mid-coat desirably consists essentially of a fire-retardant pigmented polyester polyurethane similar to the base coat. This mid-coat contains a high concentration of "opacifying" pigment. This pigment can be an organic carbon black, an inorganic titanium dioxide, or a blend of organic and inorganic pigments blended to meet a specific color.

A third coating compound forming the top coat is then applied at about 0.5 to about 1.0 mils. This top coat desirably consists essentially of a fire-retardant pigmented polyester polyurethane. The top coat is preferably applied from a solvent solution and contains a pigment and flattening agent. This coating preferably provides a dry matte surface and contains enough of an appropriate pigment to meet specified spectral reflectance properties.

The coatings are desirably provided such that a maximum of 2.0 to 2.3 ounces per yard of coating are applied to the fabric, in order to minimize overall fabric weight. In addition, although three specific coats have been described, it is noted that a greater number of coats could be realized within the scope of the invention.

The coatings can be applied via floating knife, knife over roll or any coating machine capable of applying a specified thickness of each coating compound in a separate or continuous operation. The coating compounds also desirably contain compounding ingredients to provide the maximum flame-retardancy possible as well as any antioxidants, U.V. absorbers and biocides that may be necessary to meet desired specifications. In addition to achieving a fabric having superior resistance to environmental influences, the instant invention achieves a versatile product meeting specific infrared resistance requirements on each of the respective sides by providing visual shade matches for each side, superior cold crack resistance and improved resistance to humidity aging. As a result, the number of rainflies which military personnel can be required to possess can be reduced since the reversible fly provides the desired physical and visual characteristics on each of the two differently colored sides.

The rainfly is also desirably mildew resistant, cold crack resistant, flame resistant, has a high level of hydrostatic resistance, is water repellant, resistant to blocking, has good color fastness, has high tear and tensile strength, and is relatively low in weight. Where these features are not a function of the textile substrate or major coating components themselves, additives can be included in one or more of the coating layers to provide these characteristics. It is noted that the specific concentration and combination of such additives will vary depending on the particular specifications of the end product, because in preparing the coating formulations, an addition in one element of the coating mixture to achieve one result can have accompanying effects on other features of the end product. As a result, the requisite properties desired for the end product must be taken into account in their entirety, so that the desired balance of end properties can be achieved.

The fabrics according to the instant invention are desirably waterproof, provide a high degree of opacity (i.e. blackout characteristics), ultra-violet protection, flame retardancy, cold weather crack resistance, mildew resistance, abrasion resistance, and infrared reflectance within specified wavelengths (e.g. 600–860) to avoid detection by infrared detection equipment commonly used by various branches of the military, with each side of the fabric providing these characteristics. As a result, the number of rainflies needed by military personnel is reduced, since a single fly can provide two distinct aesthetic appearances, with the physical requirements being met regardless of which color side is utilized for the rain fly exterior. While discussed specifically with respect to rain flies (which are commonly about 14 linear yards long and 60 inches wide), it is noted that the material of the instant invention could be used in other dimensions and environments where similar physical characteristics are desired, including, but not limited to window covers and equipment covers. Furthermore, though discussed particularly in connection with green on one side and tan on the other, it is noted that other two-sided color combinations are within the scope of the instant invention, such as camouflage with green, tan with white, etc.

The new process and product also enable the attainment of the requisite infrared requirements on each fabric side, and allow visual shade matches for both sides. Furthermore, an improvement in the cold crack properties has now also been achieved. In addition, the physical requirements have been able to be achieved with a reduction in overall product weight. Generally, the base or ground fabric is selected to be that which the minimum to provide required durability characteristics. For example, a 1.9 oz./sq. yd. base fabric has been found to perform desirably in the invention, although other fabrics can be used, such as 1.6 oz./sq. yd. fabrics or those of higher or lower basis weights. Alternative materials such as taffeta can also be used.

DETAILED DESCRIPTION OF THE INVENTION

The present invention now will be described more fully hereinafter with reference to the accompanying drawing, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

With reference to the drawing, FIG. 1 is a schematic cross-sectional view of a fabric 10 made according to the instant invention. As illustrated, the fabric 10 includes a first substrate layer 12 which is desirably a layer of textile fabric such a woven, knit or non-woven fabric such as those types known in the art. The fibers used to form the fabric can be natural or synthetic or combinations thereof. For example, the fabric can be cotton, cellulose, wool, rayon, polyester, nylon, acrylic, polypropylene, polyamide aramid, polyvinyl chloride or the like. In particular, the fabric is desirably made from a woven nylon fabric. The base fabric desirably has a relatively low basis weight, preferably on the order of about 1.6 to 1.9 ounces per square yard. However, other basis weight fabrics can be used within the scope of the invention and the weight will depend on such factors as the amount of coating which is expected to be applied, the specifications of the specific fabric, the type of substrate used (i.e. woven, knit or the like), etc.

The fabric has a base coating 14 applied to it which is designed to assist in tying the subsequent coating or laminate layer to the substrate and to provide good physical performance characteristics to the fabric. The base coat is desirably applied to the substrate at a thickness of about 0.25 to 0.5 ml. This coating also preferably is made from a polyester polyurethane and desirably includes a fire retardant such as antimony trioxide. This coating is desirably applied from a solvent solution with sufficiently high viscosity to prevent penetration to the face of the fabric. The coating also desirably contains a pigment closely matching the ground shade of the base fabric. The pigment volume concentration is preferably sufficiently high to prevent the ground shade from changing when the latter coatings containing opacifying compounds are applied. For example, the base coat desirably includes about 21 to about 48% polyester polyurethane, about 1 to about 2% antimony trioxide, about 3 to about 5% decadromodiphenyl oxide, about 8 to about 12% pigment (color), about 0.05 to about 0.1% biocide, and about 40 to about 60% solvent. It is noted, however, that other types of polyurethane such as polyether polyurethane can be used within the scope of the innvention, as well as other types of flame retardants, and the like.

A midcoat is then applied to the base coat, preferably at a thickness on the order of about 0.5 to 1.0 ml. This midcoat desirably comprises a fire-retardant polyester polyurethane similar to that used in forming the base coat. This coating also includes a high concentration of "opacifying" pigment. This pigment can be an organic carbon black, an inorganic titanium dioxide or a blend of organic and inorganic pigments blended to meet a specific color. For example, the midcoat can include from about 13 to about 50% polyester polyurethane, about 1 to about 2% antimony trioxide, about 3 to about 5% decabromodiphenyl oxide, about 5 to about 15% pigment, about 0.05 to 0.1% biocide and about 40 to about 65% solvent.

A top coat is then applied to the midcoat, preferably at a thickness of about 0.05 to about 1.0 ml. This compound also desirably comprises of a fire retardant polyester polyurethane. The coating is preferably applied from a solvent solution and contains a pigment and a flattening agent. This coating preferably provides a dry matte surface and contains enough of an appropriate pigment to meet specified spectral reflectance properties. This coating is designed to protect the other coatings and to assist in the retention of their functional properties. For example, the top coat desirably includes from about 13 to about 39% polyester polyurethane, about 2 to about 5% antimony trioxide, about 10 to about 15% decabromodipheny oxide, about 6 to about 12% pigment, about 0.05 to 0.1% biocide and about 45 to about 60% solvent.

Examples:

| | | Example 1 | Example 2 |
|---|---|---|---|
| | | Percentage | |
| A. Basecoat | Polyester Polyurethane | 21 | 48 |
| | Antimony Trioxide | 2 | 1 |
| | Decabromodiphenyl oxide | 5 | 3 |
| | Pigment (Color) | 12 | 8 |
| | Biocide | 0.1 | 0.05 |
| | Solvent | 60 | 40 |
| | Total | 100 | 100 |
| B. Midcoat | Polyester Polyurethane | 13 | 50 |
| | Antimony Trioxide | 2 | 1 |
| | Decabromodiphenyl oxide | 5 | 3 |
| | Pigment | 15 | 5 |
| | Biocide | 0.1 | 0.05 |
| | Solvent | 65 | 40 |
| | Total | 100 | 100 |
| C. Topcoat | Polyester Polyurethane | 13 | 39 |
| | Antimony Trioxide | 5 | 2 |
| | Decabromodiphenyl oxide | 15 | 10 |
| | Pigment | 12 | 6 |
| | Biocide | 0.1 | 0.05 |
| | Solvent | 60 | 45 |
| | Total | 100 | 100 |

The coatings are desirably provided such that a maximum of about 2.0 to 2.3 ounces per yard of coating are applied to the fabric in order to minimize overall fabric weight. However, other quantities and additional coats could be provided within the scope of the invention, depending on the precise specifications of the particular end product.

It is also desirably in many cases that the fabric exhibit other qualities such as ultra-violet protection, cold weather crack resistance, flame retardancy, mildew resistance, abrasion resistance, infra-red reflectance, water permeability, water repellency, tear resistance, color fastness, coating adhesion, flexibility, blocking resistance, weathering resistance, and the like. The precise formulations of a coating compound will therefore vary depending on the specific weight, colors, tolerance ranges, and the like, as they relate to compounds and process steps of the production process.

It is preferred that the fabric does not support the growth of mildew and mold, as such can degrade the material, thereby reducing its useful life. For example, it is desirably that the fabric supports substantially no mildew growth when tested according to ASTM G 21 and G22.

In addition, it is desirable that the fabric retain its flexibility in cold temperatures, and that it is cold crack resistant. These features ensure that the fabric can be packed and utilized in a range of temperatures without damage to the fabric, and packability and set up are facilitated. Preferably, the warp direction of the fabric, when tested according to ASTM D 1388, Option A at the specified temperature as well as at −25 degrees Farenheit, has an initial value of a maximum of 10 at the specified temperature and the −25 degrees result will be less than or equal to 15.

It is also particularly desirably that the fabric be flame resistant and/or retardant, in order to minimize the risk of fire and related injuries. In particular, it is desirable that the fabric of the invention meets the After Flame, Char Length requirements of CPAI 84 before and after weathering (using AATCC 169 Xenon Lamp.) In addition, when tested according to CPAI 84, the material desirably meets the Melt Drip requirements both before and after weathering (using AATCC 169 Xenon Lamp), with any evidence of flaming melted or molten pieces being reported as a failure.

The fabric also desirably has a high degree of hydrostatic resistance, as this is a good indicator of its waterproofing capabilities; in other words, the fabric is desirably highly waterproof and water resistant. For example, when the uncoated face of the fabric is tested according to FED STD 191 Method 5512, it should meet a requirement of 60 initially, 35 after 100 cycles of Gelbo Flexing (FED STD 191 Method 2017), and 35 after Abrasion (FED STD 191 Method 5302) at 1000 cycles abraded to itself on the coated side. Also, when tested according to the Suter Test (FED STD 191 Method 5516), with the coated side of the fabric to the water and the hydrostatic head is head at 50 cm for 5 minutes, water should appear at less than 3 places within the 4.5" diameter test area.

It is also desirable that the fabric is water repellent, to allow for a spray rating of at least 80 when tested according to AATCC 22 with the uncoated side of the fabric to the water. In this way, water resistance is enhanced, as water has a tendency to bead up and roll off, reducing later tendency for the material to leak.

The fabric is also resistant to blocking (i.e. a tendency for the material to stick to itself.) Therefore, it is desirable that the fabric achieves a rating of 3 maximum when tested according to FED STD 191 Method 5872.

As noted above, it is also desirable that the fabric has visual opacity, so that light coming from a tent beneath a rainfly made from the fabric of the invention is blocked from view outside the rainfly. In this way, for example, enemy scouts would not be enabled to readily see troops during the night simply because some light is being used inside the tent. In particular, it is desirable that it meet at least 0.030 ft. lamberts when tested using FED STD 191 Method 5781.

The fabric is also desirably colorfast, even after weathering and humidity exposure. For example, the material should provide for "good" colorfastness when tested after both Accelerated Weathering (AATCC 169 Xenon lamp) coating exposed to 100 kj of energy, and high humidity (FED STD 191 Method 5630). The coating should not become stiff and brittle, nor soft and tacky, nor should there be any evidence of cracking under visual examination. At the end of the aging period, the samples are removed from the dessicator and visually examined for color fastness.

The fabric should also have good tear strength, to ensure that the fabric will stand up over time and that tears that could be initiated or propagated by wind would be kept to a minimum. The material should therefore have sufficient resistance to tears before and after accelerated weathering. Consequently, it is preferred that the material when tested according to ASTM D 1424 provide a value of 600 grams initially and after accelerated weathering (AATCC 169 Xenon Lamp).

The fabric should also have good tensile strength. In order to provide sufficient protection against wind and wind driven rain, it will be necessary to erect the rainfly as a tensile structure and as such, it must have sufficient strength to support both its own loaded state and that offering protection in the event of windy conditions. At the same time, the strength should be maintained over time. Therefore, the fabric desirably provides a minimum tensile strength of 50 when tested both before and after accelerated weathering (AATCC 169) using ASTM D 5035.

The weight of the fabric is desirably minimized, while maintaining the functional characteristics desired. It is therefore preferred that the fabric weigh between 3.3 and 3.5 oz/sq.yd when tested according to ASTM D 3776 Option C.

Although the color of fabrics manufactured are not limited within the scope of the invention, some which are desirable for military applications are black and white, green and tan, camouflage and tan, and camouflage and black.

The process for producing the fabric can be performed as follows. The base fabric can be scoured then dyed and/or printed to achieve a desired visual appearance. The fabric is then dried and pretreated if necessary, in order to assist in the subsequent coating and/or laminating process. The fabric is then also desirably heat set and calendered if necessary. The coatings are then applied as described above via either floating knife, knife over roll or any coating or laminating machine capable of applying a specified thickness of each coating compound in a separate or continuous operation. The coatings are desirably applied in a conventional manner, with application parameters desirably being controlled to within ±5% tolerance of those recommended by the polyurethane supplier; in other words, it is desirable to control the processing temperatures and conditions to those generally recommended for polyurethane coating or lamination, as well be understood by those of ordinary skill in the art without undue experimentation. The coating compounds also desirably include compounding ingredients to provide the maximum flame retardents possible, as well as any oxidants, UV absorbers and biocide that may be necessary to meet the specific end use specifications. In addition, in order to achieve a fabric having superior resistance to environmental influences, the fabrics produced by the above method provide specific infrared resistance requirements on each of the respective fabric sides (i.e. faces) by providing visual shade matches for each side, superior cold crack resistance and improved resistance to humidity aging. As a result, military personnel can use the rainflies in each of two distinct climates or environments.

The fabrics according to the instant invention are also desirably waterproof and provide a high degree of opacity (i.e. black out characteristics), ultraviolet protection, flame retardancy, cold weather crack resistance, mildew resistance, abrasion resistance, and infrared reflectants within specified wavelengths (e.g. 600 to 860) to avoid detection by infrared detection equipment commonly used by various branches of military personnel.

The fabric can be used to make military rainflies, in addition to civilian flies, window covers, dropcloths, and the like. When used to make a military rainfly, the fabric is desirably cut to form pieces at least about four feet square, and preferably about 14 yards long and 60 inches wide.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A reversible composite fabric for use in the manufacture of military rainflies comprising:

a textile substrate having a basis weight of less than about 2 oz/sq. yard, a first visual color, and first and second faces;

a base coat secured to the first face of said textile substrate and comprising a polyurethane and at least about 8% pigment when in a 40% solvent solution;

a mid-coat secured to said base coat, said mid-coat comprising a polyurethane and at least about 5% pigment when in a 40% solvent solution; and a top coat secured to said mid-coat and comprising a polyurethane and at least about 6% pigment when in a 45% solvent solution, wherein the visual color of said top coat is visually distinct from that of said textile substrate such that opposing faces of the rainfly have different visual color appearances, and wherein each face of the fabric provides visual opacity of at least about 0.030 ft. lamberts when tested according to FED STD 191 Method 5781.

* * * * *

UNITED STATES PATENT AND TRADEMARK OFFICE

CERTIFICATE OF CORRECTION

PATENT NO. : 6,194,329 B1
DATED : February 27, 2001
INVENTOR(S) : Nelson et al.

It is certified that error appears in the above-identified patent and that said Letters Patent is hereby corrected as shown below:

Title page,
Item [56] References Cited, U.S. PATENT DOCUMENTS, last line, "5,986,773" should read -- 5,985,773 --.

Signed and Sealed this

Eighteenth Day of December, 2001

*Attest:*

*Attesting Officer*

JAMES E. ROGAN
*Director of the United States Patent and Trademark Office*